United States Patent [19]

Okamoto et al.

[11] 4,406,203

[45] Sep. 27, 1983

[54] AUTOMATIC PERFORMANCE DEVICE UTILIZING DATA HAVING VARIOUS WORD LENGTHS

[75] Inventors: Eisaku Okamoto; Kohtaro Mizuno, both of Hamamatsu, Japan

[73] Assignee: Nippon Gakki Seizo Kabushiki Kaisha, Shizuoka, Japan

[21] Appl. No.: 318,333

[22] Filed: Nov. 5, 1981

[30] Foreign Application Priority Data

Dec. 9, 1980 [JP] Japan ..... 55-173659

[51] Int. Cl.[3] ..... G10C 3/28; G10F 5/00; G10G 3/04; G10H 7/00

[52] U.S. Cl. ..... 84/1.03; 84/1.28; 84/115; 84/445; 84/462; 340/365 S

[58] Field of Search ..... 84/1.01, 1.03, 1.28, 84/115, DIG. 12, DIG. 29, 445, 462; 340/365 S

[56] References Cited

U.S. PATENT DOCUMENTS 3,955,459 5/1976 Mochida et al. ..... 84/1.01
4,174,652 11/1979 Campbell ..... 84/1.28
4,213,366 7/1980 Niimi et al. ..... 84/1.01
4,215,619 8/1980 Budelman et al. ..... 84/1.28
4,294,155 10/1981 Turner ..... 84/1.01

*Primary Examiner*—S. J. Witkowski
*Attorney, Agent, or Firm*—Koda and Androlia

[57] ABSTRACT

An automatic musical performance device including storage circuits, read out control circuits, and conversion circuits, wherein the storage circuits store a series of musical note data. Each of the musical note data is represented by multi-bits whose number is dependent on its own use frequency which means a degree of repetitive use of the data in a music. The read out control circuits read out the musical note data from said storage circuits and supply the musical note data to the conversion circuits. Then, the conversion circuits perform the code conversion of the musical note data to other musical note data whose number of bits are independent of their own use frequency. In the automatic musical performance device, musical sounds are produced or key depressing positions are indicated in accordance with the musical note data from the conversion circuits.

8 Claims, 11 Drawing Figures

FIG. 1

FIG. 3

| | CODE (MSB … LSB) | AD$_1$ (DECIMAL) | LO$_1$ (MSB … LSB) | PD$_1$ (MSB … LSB) |
|---|---|---|---|---|
| E | 0 1 0 | 256 ~ 383 | 1 0 0 0 1 0 1 | 1 1 0 1 |
| C | 1 0 1 | 640 ~ 767 | 1 0 0 1 1 1 1 | 1 1 0 1 |
| REST | 1 1 0 | 768 ~ 895 | 1 0 0 0 0 0 0 | 1 1 0 1 |
| A | 1 1 1 | 896 ~ 1023 | 1 0 0 1 0 1 1 | 1 1 0 1 |
| G | 0 0 0 0 | 0 ~ 63 | 1 0 0 1 0 0 1 | 1 1 0 0 |
| D | 0 0 0 1 | 64 ~ 127 | 1 0 0 0 0 1 0 | 1 1 0 0 |
| F | 0 0 1 0 | 128 ~ 191 | 1 0 0 0 1 1 0 | 1 1 0 0 |
| OCTAVE DOWN | 0 1 1 0 | 384 ~ 447 | 0 1 0 1 1 1 1 | 1 1 0 0 |
| OCTAVE UP | 0 1 1 1 | 448 ~ 511 | 0 1 0 0 0 0 1 | 1 1 0 0 |
| B | 1 0 0 1 | 576 ~ 639 | 1 0 0 1 1 1 0 | 1 1 0 0 |
| CHORD M | 1 0 0 0 0 | 512 ~ 543 | 0 0 1 0 0 0 0 | 1 0 1 1 |
| CHORD 7th | 0 0 1 1 0 0 | 192 ~ 207 | 0 0 1 0 0 1 0 | 1 0 1 0 |
| CHORD m | 0 0 1 1 0 1 | 208 ~ 223 | 0 0 1 0 0 0 1 | 1 0 1 0 |
| (SUB 1) | 1 0 0 0 1 0 | 544 ~ 559 | 1 1 0 0 0 0 1 | 1 0 1 0 |
| G# | 0 0 1 1 1 1 1 | 248 ~ 255 | 1 0 0 1 0 1 0 | 1 0 0 1 |
| BREAK | 1 0 0 0 1 1 0 | 560 ~ 567 | 0 1 1 1 1 1 1 | 1 0 0 1 |
| (RTS) | 0 0 1 1 1 0 0 0 | 224 ~ 227 | 1 1 0 0 1 0 1 | 1 0 0 0 |
| CHORD m7 | 0 0 1 1 1 0 0 1 | 228 ~ 231 | 0 0 1 0 0 1 1 | 1 0 0 0 |
| F# | 0 0 1 1 1 0 1 0 | 232 ~ 235 | 1 0 0 0 1 1 1 | 1 0 0 0 |
| C# | 0 0 1 1 1 0 1 1 | 236 ~ 239 | 1 0 0 0 0 0 1 | 1 0 0 0 |
| D# | 0 0 1 1 1 1 0 0 | 240 ~ 243 | 1 0 0 0 0 1 1 | 1 0 0 0 |
| A# | 0 0 1 1 1 1 0 1 | 244 ~ 247 | 1 0 0 1 1 0 1 | 1 0 0 0 |
| END | 1 0 0 0 1 1 1 0 | 568 ~ 571 | 1 1 1 1 1 1 1 | 1 0 0 0 |
| (SUB 2) | 1 0 0 0 1 1 1 1 0 | 572 ~ 573 | 1 1 0 0 0 1 0 | 0 1 1 1 |
| (SUB 3) | 1 0 0 0 1 1 1 1 1 0 | 574 | 1 1 0 0 0 1 1 | 0 1 1 0 |
| (SUB 4) | 1 0 0 0 1 1 1 1 1 1 | 575 | 1 1 0 0 1 0 0 | 0 1 1 0 |

FIG. 4

| I | II | III | IV | V | CODE (MSB … LSB) | $AD_2$ (DECIMAL) | $LO_2$ (MSB … LSB) | $PD_2$ (MSB … LSB) |
|---|---|---|---|---|---|---|---|---|
| ♪ | ♩ | ♪ | ♩ | ♬ | 0 1 | 4096 ~ 8191 | 0 0 0 0 1 | 1 1 1 0 |
| ♩ | ♪ | ♩ | ♩. | ♪ | 1 0 | 8192 ~ 12287 | 0 0 0 1 0 | 1 1 1 0 |
| ♩ | ♩. | ♪ (Br) | ♪ | ♩ | 0 0 1 | 2048 ~ 4095 | 0 0 0 1 1 | 1 1 0 1 |
| ♩. | ♩ | ♩3̄ (Br) | ♩ | ♩ | 1 1 0 | 12288 ~ 14335 | 0 0 1 0 0 | 1 1 0 1 |
| o | (SUB1) | o | ♩ (Br) | o | 0 0 0 1 | 1024 ~ 2047 | 0 0 1 0 1 | 1 1 0 0 |
| (SUB1) | ♩ (Br) | ♩ | (SUB1) | ♪ (Br) | 1 1 1 0 | 14336 ~ 15359 | 0 0 1 1 0 | 1 1 0 0 |
| ♩. | ♩ (Br) | ♩. | (SUB2) | ♩. | 0 0 0 0 1 | 512 ~ 1023 | 0 0 1 1 1 | 1 0 1 1 |
| ♩ (Br) | ♩. | ♩. | ♪ (Br) | ♬ (Br) | 1 1 1 1 0 | 15360 ~ 15871 | 0 1 0 0 0 | 1 0 1 1 |
| BREAK | ♪ (Br) | ♬ | ♩ (Br) | (SUB1) | 0 0 0 0 0 1 | 256 ~ 511 | 0 1 0 0 1 | 1 0 1 0 |
| ♩3̄ | ♬ | (SUB1) | ♩. (Br) | ♩ (Br) | 1 1 1 1 1 0 | 15872 ~ 16127 | 0 1 0 1 0 | 1 0 1 0 |
| ♪ (Br) | BREAK | (SUB2) | (RTS) | ♩. | 0 0 0 0 0 0 1 | 128 ~ 255 | 0 1 0 1 1 | 1 0 0 1 |
| (RTS) | (RTS) | (RTS) | BREAK | BREAK | 1 1 1 1 1 1 0 | 16128 ~ 16255 | 0 1 1 0 0 | 1 0 0 1 |
| ♩. (Br) | ♩. (Br) | BREAK | (RTS) | (RTS) | 0 0 0 0 0 0 0 1 | 64 ~ 127 | 0 1 1 0 1 | 1 0 0 0 |
| ♬ (Br) | ♩3̄ | ♩ (Br) | ♩. | (SUB2) | 1 1 1 1 1 1 1 0 | 16256 ~ 16319 | 0 1 1 1 0 | 1 0 0 0 |
| ♩ (Br) | ♬ | ♩3̄ | ♬ | ♩ (Br) | 0 0 0 0 0 0 0 0 1 | 32 ~ 63 | 0 1 1 1 1 | 0 1 1 1 |
| ♩. (Br) | o | ♩ (Br) | ♩3̄ | ♩. (Br) | 1 1 1 1 1 1 1 1 0 | 16320 ~ 16351 | 1 0 0 0 0 | 0 1 1 1 |
| ♬ | ♩3̄ | ♬ (Br) | ♬ | ♩3̄ | 0 0 0 0 0 0 0 0 0 1 | 16 ~ 31 | 1 0 0 0 1 | 0 1 1 0 |
| ♬ | ♬ (Br) | ♩3̄ (Br) | o | ♬ | 1 1 1 1 1 1 1 1 1 0 | 16352 ~ 16367 | 1 0 0 1 0 | 0 1 1 0 |
| ♩3̄ | ♩3̄ (Br) | ♬ | ♩3̄ | ♩3̄ | 0 0 0 0 0 0 0 0 0 0 1 | 8 ~ 15 | 1 0 0 1 1 | 0 1 0 1 |
| ♬ (Br) | ♬ (Br) | ♬ (Br) | ♬ (Br) | ♩3̄ (Br) | 1 1 1 1 1 1 1 1 1 1 0 | 16368 ~ 16375 | 1 0 1 0 0 | 0 1 0 1 |
| ♩3̄ (Br) | ♩. (Br) | ♩. (Br) | ♩3̄ (Br) | ♬ (Br) | 0 0 0 0 0 0 0 0 0 0 0 1 | 4 ~ 7 | 1 0 1 0 1 | 0 1 0 0 |
| o (Br) | o (Br) | ♩. (Br) | ♬ (Br) | ♩. (Br) | 1 1 1 1 1 1 1 1 1 1 1 0 | 16376 ~ 16379 | 1 0 1 1 0 | 0 1 0 0 |
| ♩3̄ (Br) | ♩3̄ (Br) | o (Br) | o (Br) | o (Br) | 0 0 0 0 0 0 0 0 0 0 0 0 1 | 2 ~ 3 | 1 0 1 1 1 | 0 0 1 1 |
| (SUB2) | (SUB2) | ♩3̄ (Br) | ♩3̄ (Br) | ♩3̄ (Br) | 1 1 1 1 1 1 1 1 1 1 1 1 0 | 16380 ~ 16381 | 1 1 0 0 0 | 0 0 1 1 |
| (SUB3) | (SUB3) | (SUB3) | (SUB3) | (SUB3) | 0 0 0 0 0 0 0 0 0 0 0 0 0 1 | 1 | 1 1 0 0 1 | 0 0 1 0 |
| (SUB4) | (SUB4) | (SUB4) | (SUB4) | (SUB4) | 1 1 1 1 1 1 1 1 1 1 1 1 1 0 | 16382 | 1 1 0 1 0 | 0 0 1 0 |

46'

AUTOMATIC PERFORMANCE DEVICE UTILIZING DATA HAVING VARIOUS WORD LENGTHS

BACKGROUND OF THE INVENTION

1. Field of the Invention

The present invention relates to an automatic performance device, and more particularly to an automatic performance device designed to reduce the amount of data to be stored through representing the information on musical notes by digital words with various word lengths.

2. Prior Art

A number of automatic performance devices have been known and proposed. In the conventional type of automatic performance devices proposed so far, the pitch data and the note length data for each note in progression of a series of notes are stored in a memory unit, and based on the pitch and note length data read out successively from the memory unit, a musical tone is produced or the key-press position is indicated.

However, this type of automatic performance device has been defective in that a large quantity of data must be stored and memory units with large storage capacity are required since the information on notes is represented by digital words whose word lengths are equal. Another drawback of the conventional type is that, in the case of recording the pitch and note length data in magnetic cards, etc. before storing them in memory units, the magnetic cards with large area are required, thus making the handling thereof inconvenient.

SUMMARY OF THE INVENTION

Accordingly, it is the general object of this invention to provide a new type of automatic performance device with smaller amount of data to be stored.

More specifically, the automatic performance device according to this invention is characterized in that the information on notes is represented by digital words whose word are different depending on the frequency in use of each note in a music to be performed. For example, the information on notes used frequently is represented by digital words whose word lengths are short, while the information on notes with less frequent use is represented by digital words whose word lengths are long. The information on notes thus represented is stored into the storage means, and then is read out from the storage means to produce a musical tone and/or to indicate a key-press position.

Generally, the use frequency of a note, which represents the frequency of its use, varies depending on the music to be performed, but when the information on a note is divided into pitch information and length information for the sake of analysis, the pitch information differs in use frequency depending on key of music to be performed, while the note length information differs in frequency of use depending on type of music determined by style, tempo, etc., of the music played.

In keeping with the principles of the present invention, the objects are accomplished by a unique automatic performance device wherein, in the case of forming the pitch data by encoding the pitch information, the pitch data of the music other than that in the key of C are formed in the form transposed to C, the pitch data thus formed are stored together with the key instruction data. Then, upon reproduction, the pitch data in the key of C are converted to the pitch data of the original key according to the key instruction data; further, when forming the note length data through encoding the note length information, the note length data are formed by individual encoding for each type of music, and the note length data thus obtained are stored together with the music type instruction data. Then, in the case of reproduction, the note length data are code-converted in accordance with the musical type instruction data.

BRIEF DESCRIPTION OF THE DRAWINGS

The above-mentioned and other features and objects of the present invention will become more apparent by reference to the following description taken in conjunction with the accompanying drawings, wherein like reference numerals denote like elements, and in which:

FIGS. 3 and 4 respectively show the pitch codes and the note length codes used in the note information processor;

DETAILED DESCRIPTION OF THE INVENTION

A detailed description will hereunder be given of the embodiments of the present invention with reference to the drawings.

Figure 1:
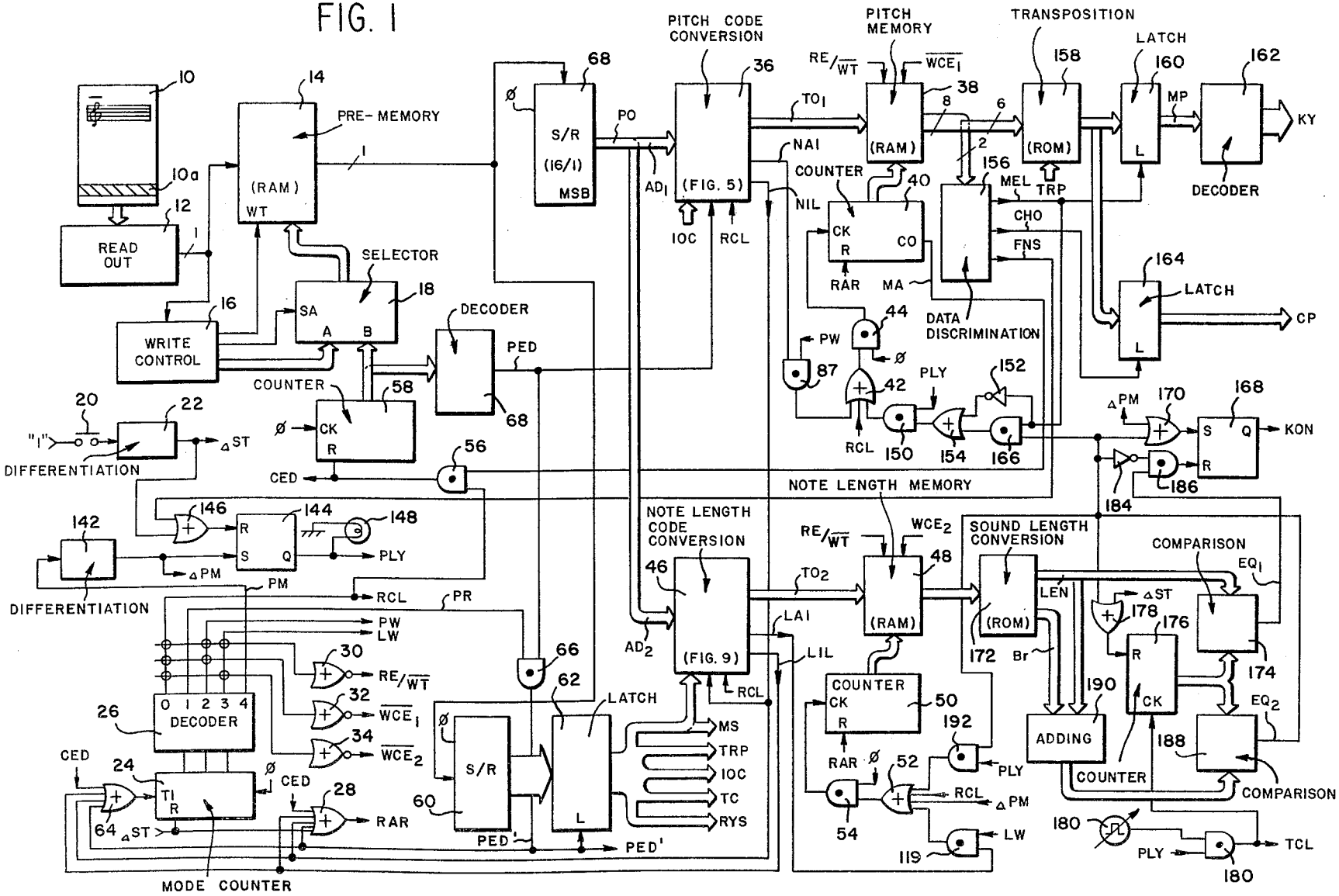
FIG. 1 is a circuit diagram showing a note information processor of an automatic performance device in accordance with the teachings of the present invention.

FIG. 1 shows a note information processor of the automatic performance device in an embodiment according to the present invention.

Figure 2:
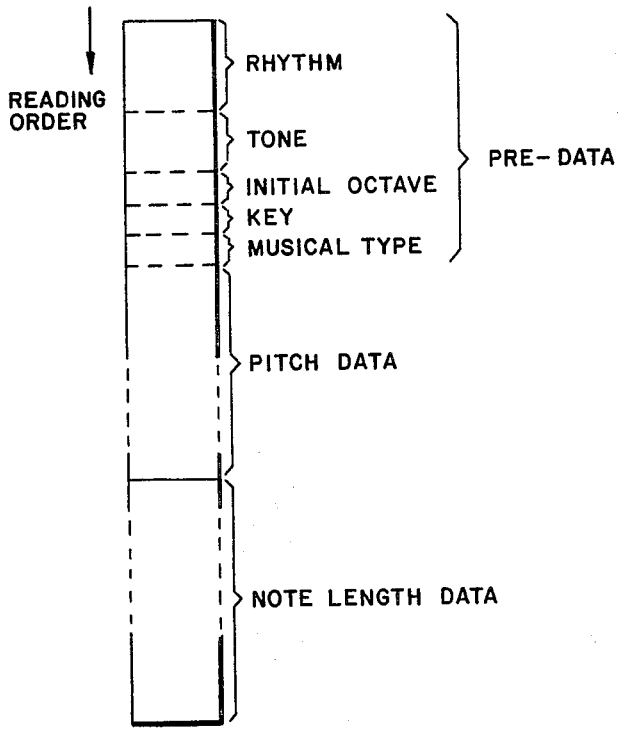
FIG. 2 is a data format used for recording score data in a recording medium and memorizing the score data in the note information processor.

A score 10 is provided at its lower part with recording medium 10 *a*, such as magnetic tape, and in the recording medium 10 *a* the score data are recorded with format as shown in FIG. 2. When the score 10 is set by inserting it to an inlet disposed in a reader 12, the reader 12 reads out the score data from the recording medium 10 *a*, and supplies said score data in a bit-serial-form to a preliminary memory unit (pre-memory) 14 comprising RAM (random access memory).

A write control circuit 16 is to supply a write-address-signal to a selector circuit 18, as an input A, based on the score data from the reader 12; and with supplying said write-address-signal, the circuit 16 supplies a write-control-signal WT to the pre-memory 14 and a select-signal SA for selecting the input A to the selector circuit 18, respectively.

The selector circuit 18 supplies the write-address-signal from the write control circuit 16 to the pre-memory 14 in accordance with the select-signal SA, when the pre-memory 14 being in write mode in accordance with the write-control-signal WT. Therefore, the pre-memory 14 takes in the score data from the reader 12 in response to the write-address-signal from the selector circuit 18, and memorizes the score data in a format shown in FIG. 2.

The format in FIG. 2 is used for recording the score data in recording medium 10 *a* and for storing the score data in the pre-memory 14 as mentioned above, and it is constructed to have the pre-data, pitch data, and note length data laid out in said sequence. Both the pitch data and the note length data are arranged in the order corresponding to the progression of the notes of the score 10.

In said format, as predata, the rhythm designating data, tone designating data, initial octave addressing data, key designating data, and musical type designating data are laid out in said order. The rhythm designating data are for controlling the autorhythm, and they are so designed as to designate one out of various rhythms, such as waltz, rumba, mambo. The tone designating data are for addressing the tone color, and they correspond to the tone color setting by a tone lever in ordinary electronic musical instrument. The initial octave designating data are represented by, for example, 2-bit binary code, and indicate the octave in initial state in performance. As will be mentioned later, the initial octave designating data are necessary for forming the octave codes according to the octave up/down data. The key designating are represented by, for example, 4-bit binary code, and they designates the key of the music to be performed. The key designating data are also necessary for processing the pitch data for transposition, as will be mentioned later. The musical type designating data are to designate the type of music to be performed, and, as will be mentioned later, are necessary for code-converting the note length data.

As shown in FIG. 3, pitch data include: note name data corresponding to 12 note names, such as C, C#, D . . . B; rest data; octave up and down data; chord data, break data; end data, subroutines SUB 1 through SUB 4; and subroutine return command RTS. In the above, the chord data are the 2-word data, whereof one word represents the chord type corresponding to one among M (major), 7th (seventh), m (minor), and m7 (minor seventh), while the another word represents a root corresponding to one of C, C# . . . B. The break date indicate the border between the pitch data and the note length data. The end data indicate the completion of a musical performance. In the Table shown in FIG. 3, the break data are placed at the position of relatively high frequency because of the assumption of the case for providing the memories corresponding to those including sub-melody. In the embodiment of FIG. 3, the "break" appears only once, but in said assumption, it appears twice. For the sake of simplification, the detailed description on subroutine process for the pitch is omitted.

Various pitch data mentioned above are coded by varying the code length, by using the Huffman code as shown in "code" column of FIG. 3. The Huffman's coding method is a method to arrange that, in a given data group, the data which are high in frequency of use are coded to be shorter in length (number of bits), while those low in use frequency are coded to be longer in code length. The characteristic feature of the method is that it requires a unique computation procedure which utilizes the use frequency of individual data in order to determine the code length of each datum.

On the other hand, as shown in FIG. 4, note length data include: the sound length data corresponding respectively to a sixteenth-note, an eighth-note, a dotted eighth-note a quarter-note, a dotted quarter-note, a half-note, a dotted half-note, a whole-note, triplet eighth-note and quarter-note (indicated by attaching the figure "3" on the right side of the note); the sound length data corresponding respectively to break notes (indicated by attaching the letters "Br" on the right side of note with parenthesis) which in turn correspond to each of the foregoing notes; the break data; the subroutines SUB 1 through SUB 4; and subroutine return command RTS. In this case, the break note is that used for obtaining a minute non-sounding period (correspond to key off) when the equal pitch data is produced in succession. The data on break and subroutine are different from those on the pitch, but their functions are similar to those for the pitch. For the sake of simplification, the detailed description on subroutine process for note length is omitted here, too.

Various note length data described above differ in use frequency, respectively, depending on the music types I, II, III, IV and V. Consequently, the note length data are coded for each music type, by using the 01 code and by varying the code length as shown in "code" column of FIG. 4. The 01 coding method is invented by the inventor of the present invention. It is similar to the foregoing Huffman's coding method in that, in a group of data, the data more frequently used are arranged to be shorter in code length, the data less frequently used are arranged to be longer in code length; however, it differs from the Huffman's coding method in that the code length of individual data is determined by varying the string length of "0" or "1" in order of use frequency, thereby unnecessitating the special computation procedure for determining the code length. The use of the 01 coding method is advantageous as it simplified the construction of note length code conversion circuit, as will be mentioned later, relating to FIG. 10.

Once the coded musical note data are stored in the pre-memory 14 by taking the foregoing processes, the RAM clear mode is started in accordance with ON-operation of the switch 20. Thereafter, following the sequence of pre-data read out mode, pitch data write mode, note length write mode, automatic performance mode, the respective operations are performed.

First, when the start switch 20 is turned on, the ON-signal at this moment is brought to rise and differentiated in a differentiation circuit 22, then converted to start signal ΔST. Said start signal ΔST acts to reset a mode counter 24 to give a RAM-clear-signal RCL decoding the count output from a zero-address output line. The start signal ΔST is also supplied to an OR gate 28; therefore, the OR gate 28 gives the RAM address-reset-signal RAR, in response to the start signal ΔST. A NOR gate 30 receiving the signals of zero-address, second and third output lines of the decoder 26 as input is to give the read-control-signal RE or the write-control-signal $\overline{WT}$; and when the RAM-clear-signal RCL="1" is given from zero-address output line of the decoder 26, the write-control-signal WT="0" is given. A NOR gate 32 receiving the signals from zero-address and second output lines of the decoder 26 as input is to give the first-write-chip-enable-signal $\overline{WCE_1}$; and when the RAM-clear-signal RCL="1" is given from the zero-address output line of the decoder 26, the signal $\overline{WCE_1}$ becomes "0". A NOR gate 34 receiving the signals from the zero-address and the third output lines of the decoder 26 as input is for giving the second write-chip-enable-signal $WCE_2$, and when the RAM-clear-signal RCL="1" is given from the zero-address output line of the decoder 26, the signal $\overline{WCE_2}$ becomes "0".

The RAM clear mode operation is performed in accordance with the aforementioned RAM-clear-signal RCL, RAM address-reset-signal RAR, write-control-signal $\overline{WT}$, first and second write-chip-enable-signals $\overline{WCE_1}$ and $\overline{WCE_2}$. In other words, the RAM-clear-signal RCL is supplied to a pitch code conversion circuit 36, and works to change the all bits of conversion output $TO_1$ to "1". The conversion output $TO_1$ with "1" in all bits is supplied to a pitch memory 38 formed by RAM. At this time, the pitch memory 38 is in the write-enable state according to the write-control-signal $\overline{WT}$ and the first-write-chip-enable-signal $\overline{WCE_1}$. The address counter 40 after getting reset in accordance with RAM-address-clear-signal RAR, counts the clock signal $\phi$ supplied as count input CK from an AND gate 44 opened in accordance with the RAM-clear-signal RCL from the OR gate 42, and supplies the write-address-signal formed by count output from said count operation to a pitch memory 38. Consequently, the conversion output $TO_1$ with "1" in whole bits is stored into the pitch memory 38 according to the write-address-signal from the counter 40, and thereby the information in all addresses of the pitch memory 38 is changed to "1". This means that the pitch memory 38 is cleared. The detailed description on the pitch code conversion circuit 36 will be given later with reference to FIG. 5.

On the other hand, a note length code conversion circuit 46 supplies the conversion output $TO_2$ with "1" in all bits to a note length memory 48 formed by RAM, in accordance with the RAM-clear-signal RCL. In this case, the note length memory 48 is in the write-enable state, in response to write-control-signal $\overline{WT}$ and the second write-chip-enable-signal $\overline{WCE_2}$. Also, after getting reset by RAM-address-reset-signal RAR, an address counter 50 counts the clock signal $\phi$ supplied from an AND gate 54 enabled by responding to the RAM-clear-signal RCL from an OR gate 52, and supplies the write-address-signal to the note length memory 48. As a result, same as in the foregoing case of the pitch memory 38, the note length memory 48 is cleared through the storage of "1" in all addresses. The detailed description on the note length code conversion circuit 46 will be given later with reference to FIG. 9.

Since the pitch memory 38 is larger in storage capacity than the note length memory 48, when the clear operation of the pitch memory 38 is completed, the clear operation of the note length memory 48 has already been completed. Therefore, in order to start the operation of the next pre-data read mode in response to the completion of the clear operation of the pitch memory 38, the maximum-address-detection-signal MA, as a carry out output CO, is drawn out from the counter 40 and supplied to the input terminal on one side of an AND gate 56. Because the RAM-clear-signal RCL has been supplied to the other side of the input terminal of the AND gate 56, the AND gate 56 gives the clear-end-signal CED in response to the maximum-address-detection-signal MA through the OR gate 28, and causes the counters 40 and 50 to be reset. The clear-end-signal CED also causes the address counter 58 to get reset; therefore, after getting reset, the counter 58 counts the clock signal $\phi$ and supplies the read-address-signal to the selector circuit 18, as input B. At this time, because the selector-signal SA is "0", the selector circuit 18 operates to select and feed the input B; consequently, the read-address-signal from the counter 58 is supplied to a shift register (S/R) 60. The shift register 60 takes in the pre-data successively according to the clock-signal $\phi$, and feeds the bit serial input pre-data to a latch circuit 62 by converting them to the bit parallel pre-data.

On the other hand, the clear-end signal CED is supplied as trigger input TI to the mode counter 24 through an OR gate 64, causing the counter 24 to step ahead by 1 count. As a result, from the first output line of the decoder 26, a pre-data read-mode-signal PR is produced and supplied to one of the input terminals of an AND gate 66. To the other input terminal of the AND gate 66, a pre-data end-signal PED is supplied synchronously with the pre-data read-end-timing, from a decoder 68 decoding the count output read-address-signal of the counter 58. Accordingly, when the pre-data read operation is completed, a pre-data end-signal PED' is given from the AND gate 66, and supplied as a latch-command-signal L to the latch circuit 62. Therefore, the latch circuit 62 latches the total of the pre-data from the shift register 60 in parallel, upon completion of the pre-data read out. In result, as a output from the latch circuit 62, corresponding to the pre-data contents shown in FIG. 2, rhythm command data RYS, tone command data TC, initial octave command data IOC, key command data TRP, and musical type command data MS are supplied.

When the pre-data read mode operation is completed as mentioned above, the pitch-data-write-mode operation starts. That is, the pre-data end-signal PED' supplied from the AND gate 66 is fed as the RAM-address-reset-signal RAR through OR gate 28, thereby resetting the counters 40 and 50, while getting supplied to the mode counter 24 through the OR gate 64 to step ahead the counter 24 by 1 count. Accordingly, a pitch-data-write-mode-signal PW is given from the second output line of the decoder 26; and at the same time, the write-control-signal $\overline{WT}$ and the first write-chip-enable-signal $\overline{WCE_1}$ are given from the NOR gates 30 and 32, respectively. The signals $\overline{WT}$ and $\overline{WCE_1}$ cause the pitch memory 38 to get into the write enable state.

On the other hand, the counter 58 gives the address-signal in order to read out pitch data, following the address signal giving operation in order to read out pre-data, and supplies said address-signal to the pre-memory 14 via the selector circuit 18. Consequently, from the pre-memory 14, the pitch data are read out successively in bit serial form and supplied to a 16 stage/1 bit shift register 68. The shift register 68 is provided for serial-parallel conversion, same as the previously mentioned shift register 60; and the parallel pitch data as its output PO undergoes the code-conversion in the pitch code conversion circuit 36.

Figure 5:
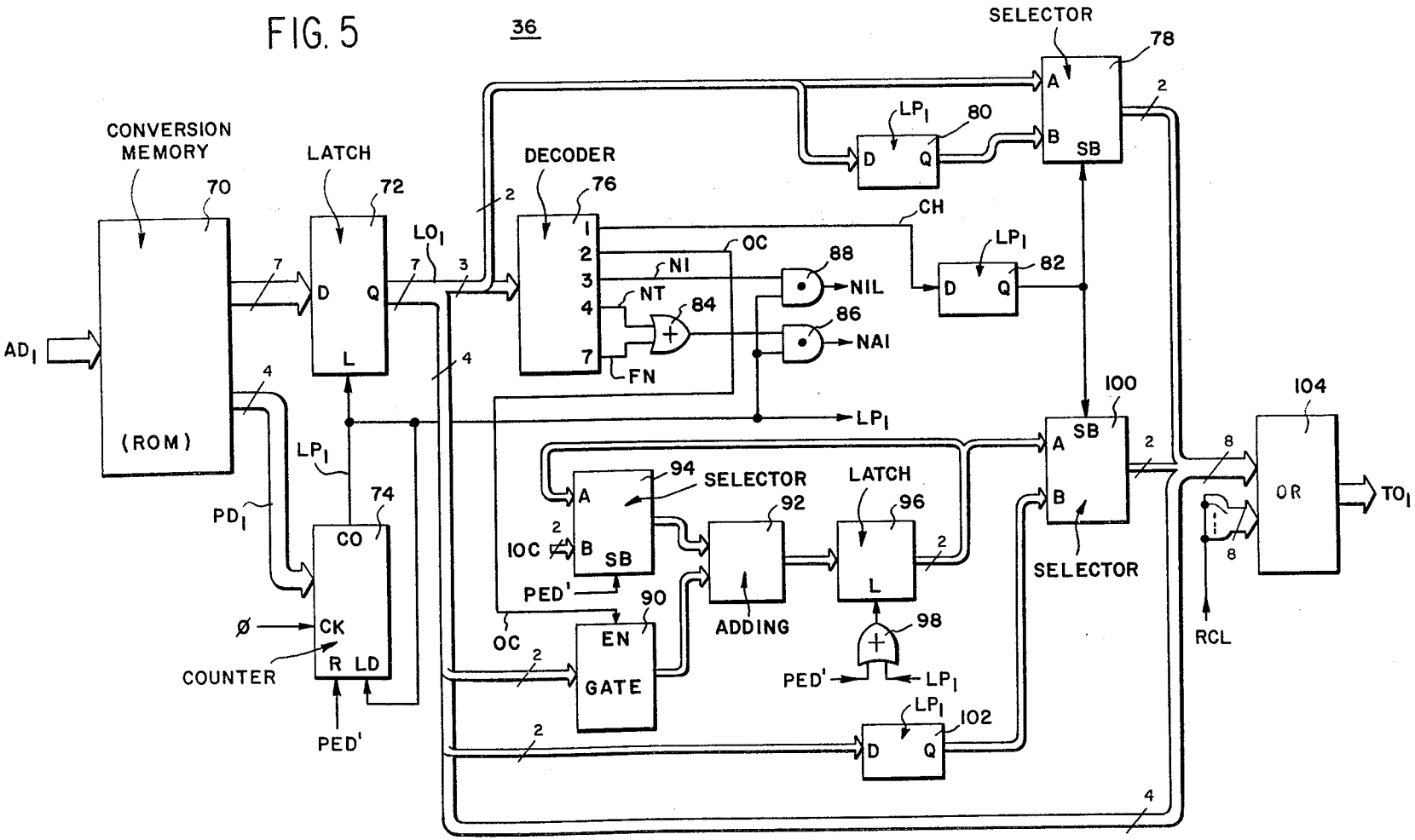
FIG. 5 is a circuit diagram showing the details of pitch code conversion circuits in the note information processor.

The pitch code conversion circuit 36 is constructed as shown in FIG. 5, and the parallel pitch data from the shift register 68 is supplied as address input $AD_1$ to a conversion memory 70 formed of ROM (read only memory). The conversion memory 70 is so designed as to supply the parallel 7 bit pitch data to a latch circuit 72 through the code-conversion of the address input $AD_1$ and also to supply the parallel 4 bit code length data to a programmable counter 74, as a preset data $PD_1$. The latch circuit 72 is to latch the pitch data from the conversion memory 70, in complying with a latch-command-signal $LP_1$ formed of the carry out output CO of the counter 74 counting the clock signal $\phi$. The interrelationship of the address input $AD_1$, the latch data $LO_1$ and the preset data $PD_1$ to the respective pitch data in this case is shown in FIG. 3. In FIG. 3, for convenience sake, the address input $AD_1$ is indicated with a decimal number.

Figure 6:
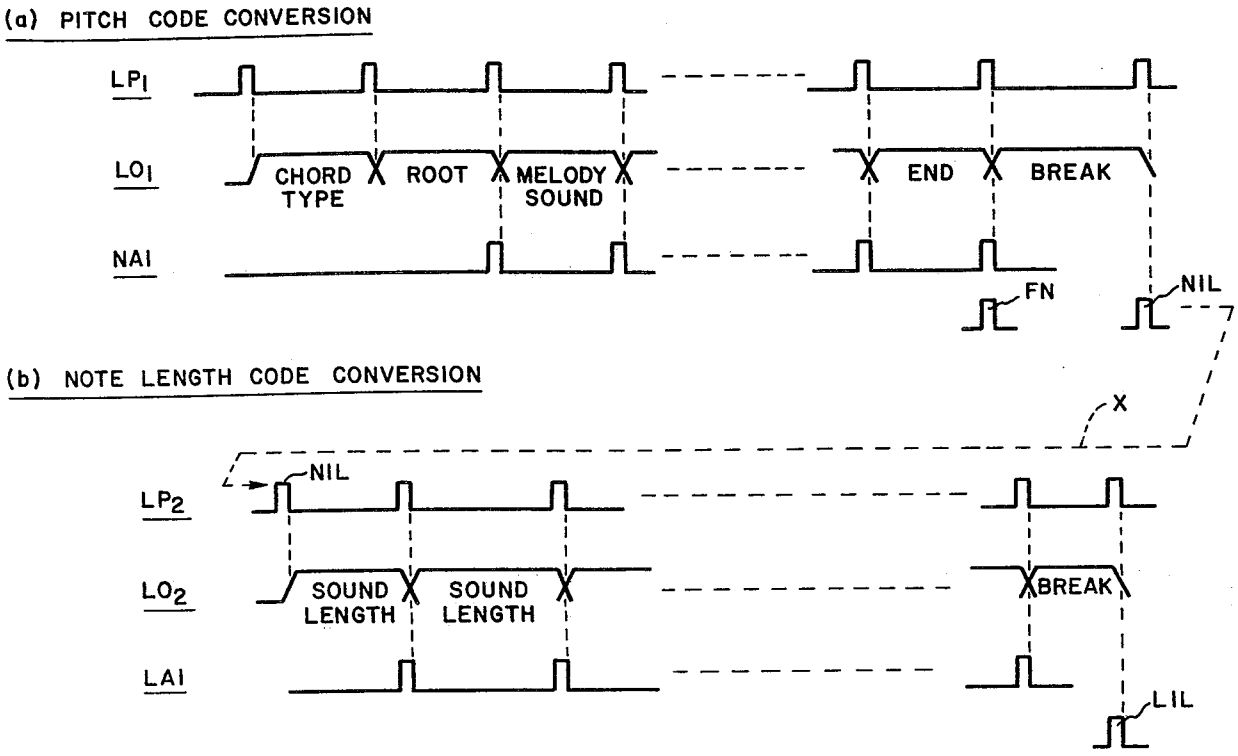
FIG. 6 is a time chart for explaining the code converting operation.

Hereunder, the description on the pitch code converting operation will be done with reference to FIG. 6(*a*). After getting reset by the foregoing predata-end-signal $PED_1$, the counter 74 produces the latch-command-signal $LP_1$ formed of the first carry out output CO, at the 16th count by counting the clock signal $\phi$. At this point of time, the MSB (most significant bit) signal of the first pitch data is transferred to the 16th stage of the shift register 68; therefore, the conversion memory 70 supplies the 7 bit pitch data and the 4 bit code length data corresponding to the first pitch data to the latch circuit 72 and to the counter 74, respectively. Consequently, in the latch circuit 72, the first 7 bit pitch data are latched in accordance with the first carry out output CO of the counter 74; while at the same time, in the counter 74, the first 4 bit code length data are preset according to the first carry out output CO. Then, the counter 74, when reaching to the count value corresponding to the code length indicated by the first code length data, gives the latch-command-signal $LP_1$ formed of the second carry out output CO. The latch-command-signal $LP_1$ at this time causes the latch circuit 72 to latch the second 7 bit pitch data, and at the same time, lets the counter 74 be preset with the second 4 bit code length data. From this on, in the same manner, every time the count value corresponding to the code length indicated by the present data $PD_1$ is reached, the counter 74 gives the latch-command-signal $LP_1$; and in response to the signal $LP_1$, latch operation for latching the pitch data and preset operation for presetting the code length data are performed. In result, to the output side of the latch circuit 72, as shown in FIG. 6(*a*), the data corresponding to the chord type, root, melody sound, etc. are supplied in sequence; then, finally, the end data and the break data are supplied in sequence; then, finally, the end data and the break data are supplied in order. Furthermore, in the automatic performance mode operation which will be mentioned later, the data read is so arranged as to be temporarily stopped during the melody sound is read out; therefore, in order to enable the simultaneous production of the melody sound and the chord, melody sound data is supplied from the conversion memory 70 in succession after chord data (chord type data and root data) has been supplied.

Figure 7:
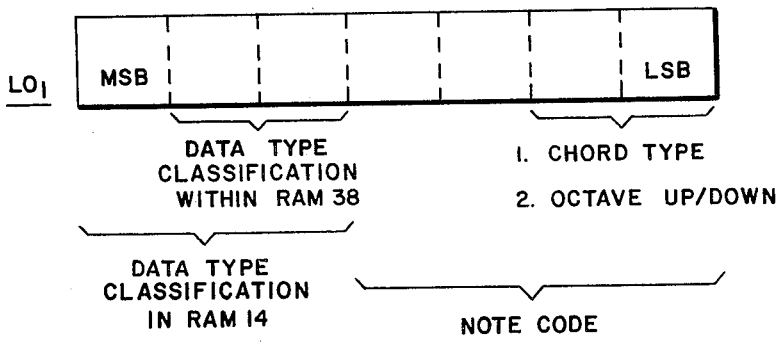
FIGS. 7 and 8 are data formats used in circuits shown in FIG. 5.
Figure 8:
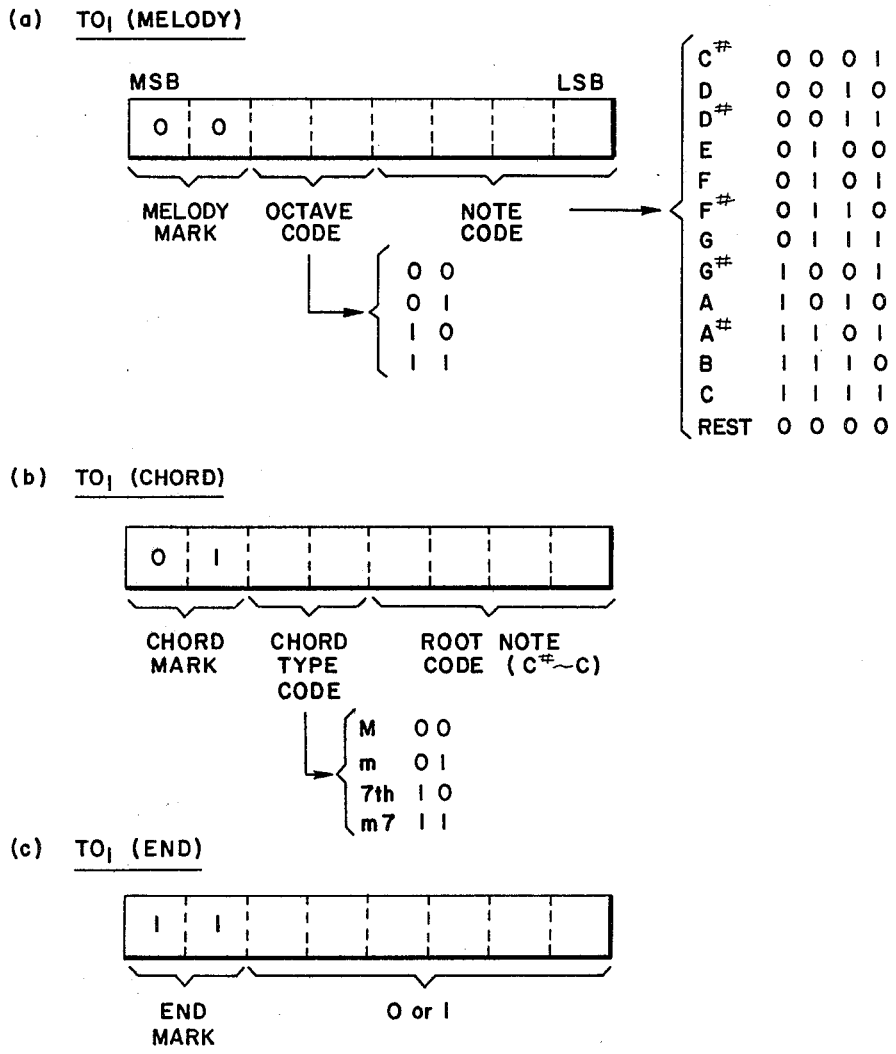

As shown in FIG. 7, the 7 bit latch data $LO_1$ from the latch circuit 72 represents the chord type or the octave up/down by its lower order 2 bits, the note code by its lower order 4 bits, the data type classification in the pre-memory 14 by its upper order 3 bits, and the data type in the pitch memory 38 by its upper order 2 bits except MBS, respectively. However for obtaining the conversion output $TO_1$ as shown in FIGS. 8(*a*), 8(*b*) and 8(*c*), the latch data $LO_1$ are further converted into another code in the circuit following the latch circuit 72.

In other words, the signal of the upper order 3 bits in the latch data $LO_1$ is supplied to the decoder 76, and the decoder 76 gives the following signals respectively, by checking the input signal; the chord-type-identification-signal CH for the chord type data; the note-code-identification-signal NT for the note code data (the pitch data on melody sound or root); the octave-up/down-identification-signal OC for the octave up/down data; the end-identification-signal FN for the end data; and the break-identification-signal NI for the break data. Also, among the 3 bit signal supplied to a decoder 76, the lower order 2 bit signal is supplied to a selector circuit 78, as input A, and at the same time, it is supplied to a D-flip-flop 80. The output of the flip-flop 80 is supplied to the selector circuit 78, as the input B. The selector circuit 78 selects and feeds the input B when the selector-signal SB, which is formed of the output signal of the D-flip-flop 82 receiving the chord-type-identification-signal CH as input, is "1" but otherwise selects and sends out the input A. The output of 2 bits outputted from the selector circuit 78 indicates the melody mark, the chord mark, or the end mark, as shown in FIGS. 8(*a*) through (*c*).

An OR gate 84 receives the note-code-identification-signal NT and the end-identification-signal FN as its inputs, and its output signal is supplied to an AND gate 86 together with the latch-command-signal $LP_1$. When the decoder 76 detects the note code data or the end data, the AND gate 86 supplies the address-go-signal NAI to one of the input terminals of the AND gate 87 of FIG. 1, in response to the output signal of the OR gate 84. At this time, to the another input terminal of the AND gate 87, a pitch-data-write-mode-signal PW is supplied from the decoder 26; therefore, the address-go-signal NAI is supplied to the AND gate 44 through the AND gate 87, and the OR gate 42, thereby the AND gate 44 is enabled. Consequently, the clock signal $\phi$ is supplied to the counter 40 by way of the AND gate 44, causing the counter 40 to supply the write-address-signal to the pitch memory 38; and in response to this, the pitch data as a conversion output $TO_1$ of the pitch code conversion circuit 36 is stored in the memory 38.

In FIG. 5, the AND gate 88 is to give the break-signal NIL by receiving the break-identification-signal NI and the latch command-signal $LP_1$, as input; and the break-signal NIL is supplied to the note length conversion circuit 46 as well as to the OR gates 28 and 64. The break-signal NIL is to start the note length write mode operation which will be described later.

The signal of the lower order 2 bits of the latch data $LO_1$ is supplied to an adding circuit 92, as an addition input of the one side, when the gate circuit 90 gets into enable (EN) state according to the octave up/down-identification-signal OC from the decoder 76. As an addition input to the other side of the adding circuit 92, the output data of the selector circuit 94 are supplied, and the output data of the adding circut 92 are supplied to the latch circuit 96. The latch circuit 96 performs the latch operation in accordance with the output-signal of the OR gate 98 which receives the pre-data-end-signal PED' and the latch-command-signal $LP_1$ as inputs; and its 2 bit latch data is supplied to the selector circuit 94 as input A. As the input B of the selector circuit 94, the 2 bit initial-octave-command-signal IOC is supplied. The selector circuit 94 selects and feeds the input B when the selection-signal SB made of the pre-data-end-signal PED' is "1", and otherwise, selects and feeds the input A. The circuit system including circuits 90, 92, 94, 96 and 98 is to form the 2 bits octave code data; and the octave code data are supplied to the selector circuit 100 as input to one side of it from the latch circuit 96. As the input B to the other side of the selector circuit 100, the chord type code data are supplied from a D-flip-flop 102 having the signal of the lower order 2 bits in the latch data $LO_1$ as input. A selector circuit 100 operates in the same manner as the previously mentioned selector circuit 78; and when the selection signal SB made of the output signal of the flip-flop 82 is "1", the circuit 100 selects and sends out the input B, but otherwise, it selects and feeds the input A. The 2 bits output from the selector circuit 100 indicates the octave code or the chord type code. The D-flip-flops 80, 82 and 102 are provided for synchronizing the chord type code data and the root note code data, and all of them are controlled by the latch-command-signal $LP_1$.

The lower order 4 bits signal of the latch data $LO_1$ indicates the note code of the melody sound or of the root sound, and is supplied to the OR circuit 104 as a 8 bit data by getting combined with the data of 4 bits in total from the selector circuits 78 and 100, then sent out from the OR circuit 104 as the conversion output $TO_1$. To the OR circuit 104, the RAM-clear-signal RCL is also supplied to produce the conversion output $TO_1$ so that all of 8 bits become "1" in the case of aforementioned RAM clear mode.

Hereunder, again with reference to FIG. 6(*a*), the description will be given on the operation to store the latch data $LO_1$ in the pitch memory 38 through processing with code conversion.

First when the chord type data are formed as the latch data $LO_1$, the decoder 76 gives the chord-type-identification-signal CH; and the signal CH is received into the flip-flop 82 in response to the latch-command-signal $LP_1$. Simultaneously, in complying with the latch-command-signal $LP_1$, the chord mark data "01" are taken into the flip-flop 80. Next, when the root data are produced as the latch data $LO_1$ in response to the next latch-command-signal $LP_1$, the flip-flop 82 supplies the previously acquired signal CH to the selector circuits 78 and 100, as selection-signal SB. Concurrently with it, the chord mark data are supplied from the flip-flop 80 to the selector circuit 78, while the chord type code data are supplied to the selector circuit 100 from the flip-flop 102, respectively. Consequently, the chord mark data and the chord type code data are selected and sent out from the selector circuits 78 and 100, respectively; and the respective data are combined with the root code data composed of lower order 4 bits of the latch data $LO_1$, then supplied to the OR circuit 104, as the 8 bit chord data. Therefore, as the conversion output $TO_1$ from the OR circuit 104, the chord data with the format as shown in FIG. 8(*b*) are supplied. At this time, since the note-code-identification-signal NT is given from the decoder 76, in response to the signal NT, the address-go-signal NAI is produced from the AND gate 86. The address-go-signal NAI enables the counter 40 to supply the write-address-signal to the pitch memory 38 in the manner mentioned before; therefore, the chord data from the OR circuit 104 are received and memorized by the pitch memory 38.

Next, when the melody sound data are formed as the latch data $LO_1$, because the selection-signal SB is "0", the selector circuit 78 produces the melody mark data "00" and the selector circuit 100 produces the octave code data, respectively. In this case, the content of the octave code data corresponds to the result of the previous operation done by the adding circuit 92; but this time, because the adding circuit 92 performed neither addition nor subtraction even once, the content of the adding circuit 92 is same as the content of the initial octave command data IOC. In other words, the initial octave command data IOC selected and fed from the selector circuit 94 in response to the pre-data-end-signal PED' are supplied to the latch circuit 96 by way of the adding circuit 92, thereafter the data IOC is latched there in accordance with the signal PED', fedback to the latch circuit 96 through the selector circuit 94 and the adding circuit 92, and then latched by said latch circuit 96 according to the latch-command-signal $LP_1$. Therefore, the selector circuit 100 selects and sends out the initial octave command data from the latch circuit 96 as an octave code data. The above melody mark data and the octave code data are combined with the note code data composed of the lower order 4 bits of the latch data $LO_1$ and supplied to the OR circuit 104, as 8 bit melody sound data. As conversion output $TO_1$ from the OR circuit 104, the melody sound data having the format as shown in FIG. 8(*a*) are outputted. At this time the note-code-identification-signal NT is produced from the decoder 76; and according to the signal NT, the address-go-signal NAI is produced from the AND gate 86. As a result, in the same manner as in the aforesaid case of the chord data, the melody sound data from the OR circuit 104 are stored in the memory 38.

Thereafter, when the octave up data or the octave down data are formed as latch data $LO_1$, the octave-up/down-identification-signal OC is given from the decoder 76, causing the gate circuit 90 to be enabled in accordance with said signal OC. As a result, in the case of octave-up, the adding circuit 94 forms the octave code higher by one octave through adding "01" to the initial octave command data IOC, while in the case of octave-down, the circuit 92 forms the octave code lower by one octave, by actually subtracting one through adding "11" to the initial octave command data IOC. Consequently, in the pitch memory 38 the melody sound data showing the pitch higher by one octave than the previous one are stored in the case of octave-up, and the melody sound data showing the pitch lower by one octave than the previous one are stored in the case of octave down.

In the manner mentioned above, a series of chord data or melody sound data are stored in the pitch memory 38 by following the order to be sounded, and after then, as latch data $LO_1$, the end data are formed. The higher order 2 bits "11" of said end data are supplied as end mark data, via the selector circuit 78. Together with output of the selector circuit 100, the end mark data are combined with the lower order 4 bits of the latch data and supplied to the OR circuit 104 as 8 bit end data. In this case, the lower order 6 bits of the 8 bits can be either "0" or "1", and as conversion output $TO_1$ from the OR circuit 104, the end data with the format as shown in FIG. 8(*c*) are outputted. At this time, from the decoder 76 the end-identification-signal FN is fed; and responding to said signal FN, the address-go-signal NAI is supplied from the AND gate 86. Accordingly, in the same manner as in the case of the foregoing chord data, the end data from the OR circuit 104 are received by the pitch memory 38 and stored in it.

Finally, as latch data $LO_1$, the break data are produced. According to the break data, the break-identification-signal NI is given from the decoder 76; and responding to the signal NI, the break-signal NIL is supplied from the AND gate 88. The break-signal NIL functions as first latch-command-signal $LP_2$ in the note length converting operation, as shown by the broken line X in FIG. 6.

When the operation of the pitch data write mode is completed as mentioned above, the note length write mode operation starts. That is, the break-signal NIL which is supplied from the pitch code conversion circuit 36 in FIG. 1 in the manner mentioned above is sent out as RAM-address-reset-signal RAR through the OR gate 28, and reset the counter 40 and 50; while it is supplied to the mode counter 24 by way of the OR gate 64, causing the counter 24 to step foward by one count. As a result, the note-length-data-write-mode-signal LW is produced from the third output line of the decoder 26; and at the same time, the write-control-signal WT and the second write-chip-enable-signal $WCE_2$ are supplied from the NOR gates 30 and 34, respectively. Said signals WT and $WCE_2$ bring the note length memory 48 into the write enable state.

On the other hand, the counter 58 gives the address-signal to read out the note length data, following the address signal supply operation for reading the pitch data, and supplies the address signal to the pre-memory 14 via the selector circuit 18. Consequently, the note length data are read out successively in a bit serial form the pre-memory 14; and the serial note length data are supplied to the note length code conversion circuit 46 in the form converted to the parallel data PO in the shift register 68, same as in the previously mentioned case of the pitch data.

Figure 9:
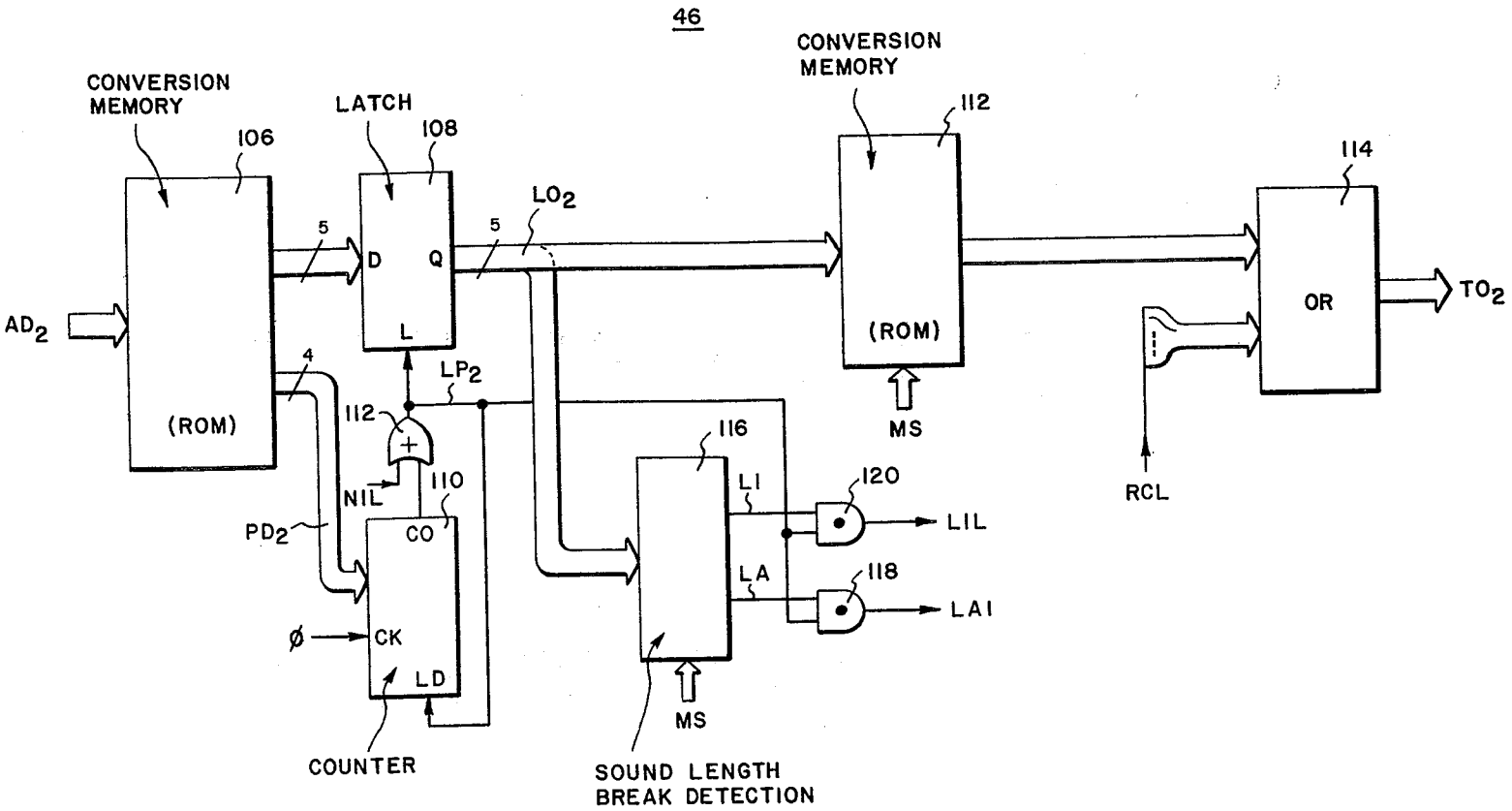
FIG. 9 is a circuit diagram showing the details of note length code conversion circuits in the note information processor.

The note length code conversion circuit 46 is so constructed as shown in FIG. 9, and the parallel note length data from the shift register 68 are supplied to a conversion memory 106 formed of ROM as address $AD_2$. The conversion memory 106 is to supply, through the code conversion of the address input $AD_2$ the parallel 5 bit note length data to a latch circuit 108, and also to supply the parallel 4 bit code length data to a programmable counter 110 as preset data $PD_2$. The latch circuit 108 is so designed as to latch the note length data from the conversion memory 106 in response to the latch-command-signal $LP_2$ from an OR gate 112 receiving a carry out output CO of the counter 110 for counting the clock signal $\phi$ as well as the previously mentioned break-signal NIL as inputs. In this case, the interrelationship between the respective note length data and the address input $AD_2$, the latch data $LO_2$, and preset data $PD_2$ is shown in FIG. 4. In FIG. 4, for convenience, the address input $AD_2$ is shown by the decimal numeral.

The note length data as latch data $LO_2$ are supplied to the conversion memory 112 made of ROM, wherein said note length data are converted to the note length data corresponding to the specific musical type in accordance with the musical type command data MS. The note length data from the conversion memory 112 are given as conversion output $TO_2$ through the OR circuit 114. The RAM clear signal RCL is also supplied to the OR circuit 114 to produce the conversion output $TO_2$ whose all bits is "1" in the case of RAM clear mode mentioned previously.

The note length data as latch data $LO_2$ are supplied also to a sound length-break detection circuit 116. The detection circuit 116 checks the input note length data according to the musical type command data MS, and then gives a sound-length-detection-signal LA for the sound length data and gives a break-detection-signal LI for the break data, respectively. The sound-length-detection-signal LA and the break-detection-signal LI are supplied to the input terminal on each one side of AND gates 118 and 120, respectively; and the latch-command-signal $LP_2$ is supplied to each input terminal on the other side of the AND gates 118 and 120. As a result, from the AND gate 118 an address-go-signal LAI is given every time the detection circuit 116 detects the sound length data in response to the sound length detection signal LA; while from the AND gate 120 a break signal LIL is given in response to the break detection signal LI when the detection circuit 116 detects the break data.

The address-go-signal LAI is supplied as input to the other side of an AND gate 119 (FIG. 1) receiving a note-length-data-write-mode-signal LW as input to the one side. When the address-go-signal LAI is given, the output-signal of the AND gate 119 is supplied to the AND gate 54 through the OR gate 52, causing it to be enabled. As a result, the clock-signal $\phi$ is supplied to the counter 50 through the AND gate 54; therefore, the counter 50 counts the clock-signal $\phi$ and supplies the write-address-signal to the note length memory 48. Responding to the write-address-signal, the note length data as conversion output $TO_2$ of the note length code conversion circuit 46 are stored in the memory 38.

The break-signal LIL from an AND gate 120 in FIG. 9 is supplied to the OR gates 28 and 64 in FIG. 1 and used to start the automatic performance mode which will be mentioned later.

Next, with reference to FIG. 6(*b*), the description will be given on the note length code converting operation as well as the operation to store the data into the note length memory 48 which are to be performed in the circuit shown in FIG. 9. When the previously mentioned pitch data write operation is completed, the OR gate 112 gives the first latch-command-signal $LP_2$ in accordance with the break-signal NIL. In response to the latch-command-signal $LP_2$, the first sound length data are latched by the latch circuit 108, and the first code length data are preset in the counter 110. Then, the counter 110 counts the clock-signal $\phi$; and when the count value corresponding to the code length shown by the first code length data is reached, the counter 110 gives the first carry out output CO. In response to the carry out output CO, the OR gate 112 gives the second latch-command-signal $LP_2$. The latch-command-signal $LP_2$ at this time causes the latch circuit 108 to latch the second sound length data and also lets the counter 110 get preset with the second code length data. Thereafter, in the same manner, the counter 110 gives the latch-command-signal $LP_2$ every time the count value corresponding to the code length shown by the preset data $PD_2$ is reached; and in response to said signal $LP_2$, the sound length data latch operation and the code length data preset operation are performed. As a result, as shown in FIG. 6(*b*), the sound length data are supplied to the output side of the latch circuit 108 successively; and finally, the break data are supplied.

When the sound length data are fed from the latch circuit 108 as first latch data $LO_2$, the detection circuit 116 gives the sound-length-detection-signal LA; therefore, in response to said signal LA, the address-go-signal LAI is given from an AND gate 118. At this time, the first sound length data from the latch circuit 108 is supplied to the note length memory 48 through the OR circuit 114 after code conversion in the conversion memory 112 in accordance with the musical type. As mentioned above, since the address-go-signal LAI enables the counter 50 to supply the write-address-signal to the note length memory 48 in FIG. 1, the first sound length data from the note length code conversion circuit 46 are stored in the note length memory 48. Thereafter, in the same manner, the sound length data are stored one after another in the note length memory 48.

Finally, when the break data are given as latch data $LO_2$, the detection circuit 116 gives the break-detection-signal LI; and in accordance with said signal LI, the break-signal LIL is supplied from the AND gate 120. The break signal LIL starts the operation of automatic performance mode which will be mentioned later.

Figure 10:
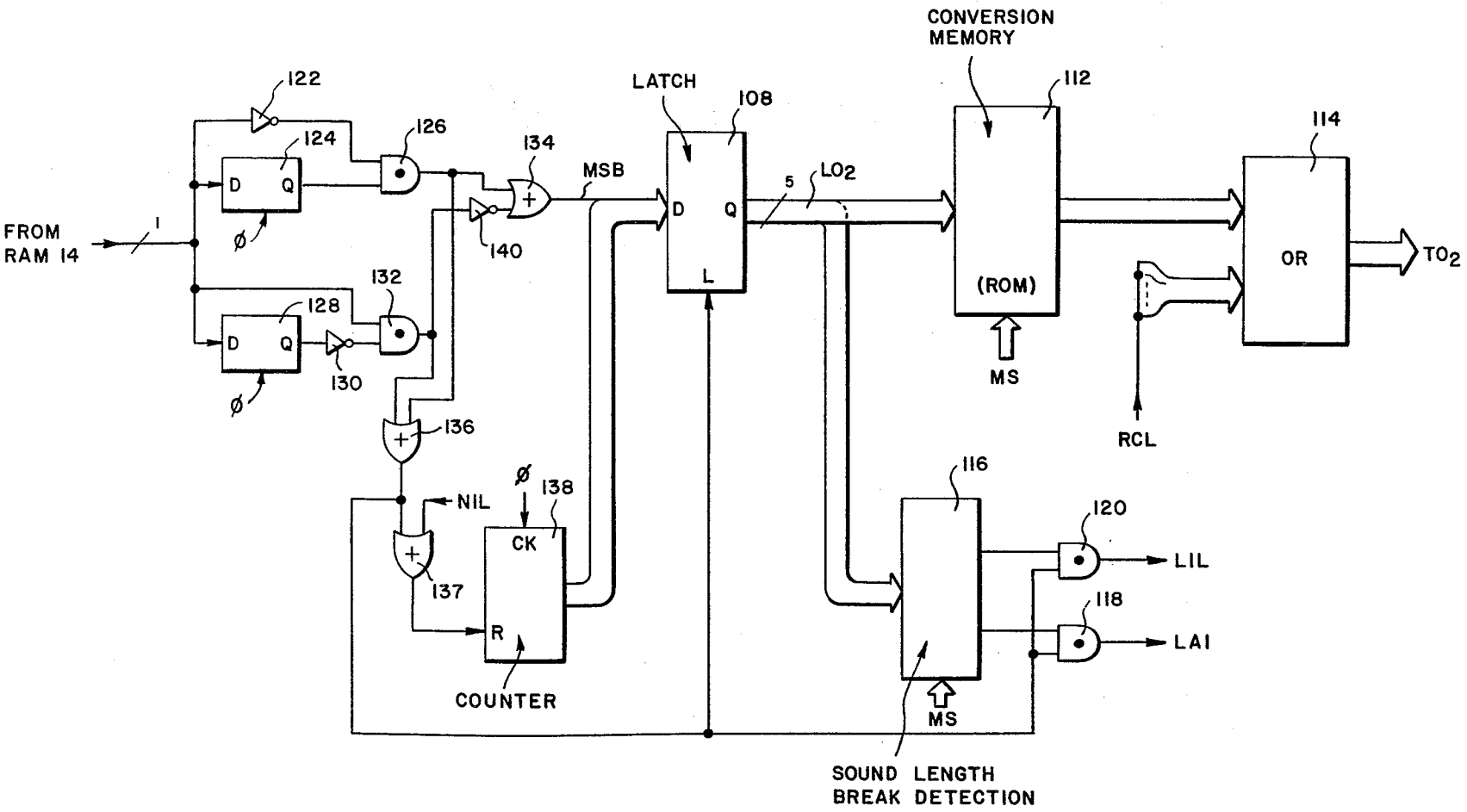
FIG. 10 is a circuit diagram showing the note code conversion circuits in another embodiment according to this invention.

FIG. 10 shows the note length conversion circuit 46' of the other embodiment according to this invention; and the detailed description on the elements same as in FIG. 9 are omitted by giving the same reference labels. The characteristic feature of this embodiment is that it is designed to be able to convert the bit serial tone length data from the pre-memory 14 to the latch data $LO_2$ without using the conversion memory etc., different from the case shown in FIG. 9. In other words, the circuit 46' in FIG. 10 is characterized in that, because the note length data from the pre-memory 14 are supplied continuously in the form of "0 . . . 01" or "1 . . . 10", it detects the change from "0" to "1" or from "1" to "0" and forms the signal MSB, and also counts the number of "0" or "1" to form the signal of bits lower in order than MSB.

In FIG. 10, the circuit including an inverter 122, a D-flip-flop 124 and an AND gate 126 is to detect the change from "1" to "0"; and the circuit including a D-flip-flop 128, an inverter 130 and an AND gate 132 is to detect the change from "0" to "1". The "1" "0" change detection output from the AND gate 126 is supplied to a latch circuit 108 through an OR gate 134, as signal of MSB; while it is also supplied to a counter 138 through OR gates 136 and 137, as reset signal. The "0" "1" change detection output from the AND gate 132 is supplied to the latch circuit 108 through an inverter 140 and the OR gate 134, as signal of MSB, and also supplied to the counter 138 through the OR gates 136 and 137, a reset signal. The break-signal NIL is, as reset-signal, supplied to the counter 138 through the OR gate 137. The counter 138 is to count the clock signal $\phi$ and to supply the count output corresponding to the number of "0" or "1" to the latch circuit 108, after getting reset in response to the reset signal from the OR gate 137. The latch circuit 108 is to perform the latch operation in accordance with the output signal from the OR gate 136, and the reset operation of the counter 138 is so designed as to get slightly delayed than the latch operation of the latch circuit 108. The output signal of the OR gate 136 is supplied also to AND gates 118 and 120.

For example, if the note length data from the pre-memory 14 are "0 . . . 01" since this input data are supplied to the AND gate 132 as one input through the inverter 130, after being delayed for the portion equivalent to 1 bit time of the clock signal $\phi$ in the flip-flop 128, at the timing when the input of the other side of the AND gate age 132 becomes "1" in accordance with the input data, the out of the inverter 130, i.e., the input of the one side of the AND gate 132, is "1". Hence, the AND gate 132 gives the detection output=1" corresponding to the change form "0" to "1", and said detection output is supplied to the latch circuit 108, as signal of MSB, through the OR gate 134 after converted to the "0" signal in the inverter 140. On the other hand, the counter 138 has counted the clock-signal $\phi$, after getting reset in response to the break signal NIL; and upon the production of the detection output of the AND gate 132, the counter 138 supplies the count output corresponding to the number of "0" of the input data to the latch circuit 108. Consequently, the latch circuit 108 latches the MSB signal from the OR gate 134 as well as the count output form the counter 138, according to the latch-command-signal from the OR gate 136. Then, delaying slightly from the latch time point, the counter 138 is reset. By the abovementioned operation, as the latch data $LO_2$, the data composed of the count output corresponding to the number of "0" of the bits other than MSB with "0" in MSB are obtained.

Next, if the note length data from the pre-memory 14 are "1 . . . 10" the input data are supplied to the AND gate 126 as the input to the one side of it after delayed by 1 bit time of the clock signal $\phi$ in the flip-flop 124; therefore, at the time when the output of the inverter 122, i.e., the input of the other side of the AND gate 126, becomes "1" in response to the input data, the input of the one side of the AND gate 126 (the output of the flip-flop 124) is "1". As a result, the AND gate 126 gives the detection output="1" according to the change from "1" to "0", and said detection output is supplied to the latch circuit 108, as signal of MSB through the OR gate 134. At this time, the counter 138 supplies the count output corresponding to the number of "1" of the input data as the result of counting the clock signal $\phi$ after getting reset by responding to the "0" "1" change detection output from the AND gate 132. Therefore, the latch circuit 108 latches the signal of MSB as well as the count output from the counter 138, in response to the latch-command signal from the OR gate 136. Then, delaying slightly from said latch time point, the counter 138 is reset. By the operation mentioned above, as latch data $LO_2$, the data composed of the count output corresponding to the number of "1" in bits other than the MSB, with "1" in MSB, are obtained.

Next, with reference to FIG. 1, the description on the automatic performance mode based on the memory data of the pitch memory 38 and the note length memory 48 will be given. As mentioned previously, the note length code conversion circuit 46 supplies the break-signal LIL to the OR gates 28 and 64, upon completion of the note length data write mode operation. The break-signal LIL is supplied as RAM-address-reset-signal RAR through the OR gate 28, and causes the counters 40 and 50 to be reset; while it is also supplied to the mode counter 24 through the OR gate 64 and lets the counter 24 step ahead by one count. As a result, from the 4th output line of the decoder 26, the automatic-performance-mode-signal PM is given; and also, from the NOR gate 30, the read-control-signal RE="1" is given. The read-control-signal RE brings the pitch memory 38 and the note length memory 48 to the read enable state.

The automatic-performance-mode-signal PM is supplied to the R-S flip-flop 144, after rising and getting differentiated in the differentiating circuit 142. As the flip-flop 144 was reset by the start signal $\Delta ST$ from the OR gate 146, it is set according to the differential output $\Delta PM$ from the differentiating circuit 142. Accordingly, the performance-state-signal PLY composed of the flip-flop 144's output Q="1" is supplied from the flip-flop 144. The performance-state-signal PLY is to maintain the "1" state during the automatic performance period; and the play display lamp 148 is operated for turning on in accordance with the performance-state-signal PLY during the automatic performance period.

The performance-state-signal PLY is supplied to the input terminal on one side of an AND gate 150. At this time, as the output="1" of an inverter 152 is supplied to the input terminal on the other side of the AND gate 150 through an OR gate 154, the AND gate 150 supplies the output="1". The output of the AND gate 150 in this case is supplied to the AND gate 44 through the OR gate 42, causing it to be enabled; therefore, the clock-signal $\phi$ is supplied to the counter 40 from the AND gate 44. Consequently, the counter 40 supplies the first read-address-signal to the pitch memory 38; and from the memory 38, the first 8 bit pitch data are read out. Of the pitch data of this time, the signal of the upper order 2 bits indicating the data type is supplied to the data discrimination circuit 156; and the signal of the lower 6 bits indicating the pitch of the melody sound or the chord is supplied to the transposition circuit 158 composed of ROM.

In the above, the data discrimination circuit 156 discriminates the data type according to the input signal, and gives the following signals depending on the type of data, respectively: the melody-sound-discrimination-signal MEL for melody sound data; chord-discrimination-signal CHO for the chord data; and the end-discrimination-signal FNS for the end data. The transposition circuit 158 is to convert the input data to the pitch data corresponding to the specific tone, according to the tone command data TRP. As mentioned previously, since the pitch data stored in the recording medium 10*a* or the pre-memory 14 are the data converted to the key in C for the music except C, the input data are converted in a transposition circuit 158 to the data of original tone according to the tone command data TRP. Accordingly, the input data of the transposition circuit 158 are identical to each other for the music of C in key, but are different from each other as to the music other than the C in key.

When the pitch data read out at first from the pitch memory 38 are the melody sound data, the melody sound data are fed from the transposition circuit 158; and said data are latched in a latch circuit 160 in accordance with the melody-sound-discrimination-signal MEL. The melody sound data MP latched by the latch circuit 160 are converted to the keying-signal KY corresponding to the number of keys in the decoder 162 and supplied to the musical sound producing unit in FIG. 11. When the first pitch data from the pitch memory 38 are the chord data, the chord data are given from the transposition circuit 158, and the data are latched in the latch circuit 164 in accordance with the chord-discrimination-signal CHO. The chord data CP latched in the latch circuit 164 are also supplied to the musical sound producing unit in FIG. 11. In this case, following the chord data, the first melody sound data are read out from the pitch memory 38, and in the same manner as that mentioned above, latched by the latch circuit 160 through the transposition circuit 158; then, the keying-signal KY corresponding to said latch data is supplied to the musical sound producing unit in FIG. 11 from a decoder 162.

In every case mentioned above, when the first melody sound data are read out from the pitch memory 38, the melody-sound-discrimination-signal MEL causes the output of the inverter 152 to be "0"; as a result, the advancement of the counter 40 is stopped temporarily, and also the data read out from the pitch memory 38 is suspended temporarily. The read out operation continues to stop until "1" signal as input is received by one side of an AND gate 166 receiving the melody-sound-discrimination-signal MEL as input to the other side of it. The "1" signal is supplied from the note length measuring unit which will be mentioned later. As described as to the previously shown example, in the case of reading out chord data, there is not the stop in data read out as in the case of reading out melody sound, and the next data are read out immediately following the previous one.

On the other hand, since the differentiation output ΔPM is supplied as set input to the R-S flip-flop 168 from the differentiating circuit 142 through an OR gate 170, the flip-flop 168 gives the key-on-signal KON composed of its output A="1" by synchronizing with the time when the performance-state-signal PLY becomes "1". The key-on-signal KON at this time is to produce the first melody sound, and is supplied to the musical sound producing unit in FIG. 11.

The differentiation output ΔPM from the differentiating circuit 142 is supplied to the AND gate 54 through the OR gate 52, causing it to be enabled; therefore, the clock signal $\phi$ supplied to the counter 50 through the AND gate 54. Consequently, the counter 50 supplies the first read-address-signal to the note length memory 48, and the first sound length data corresponding to the first melody sound are read out from the memory 48.

Said first sound length data are supplied to a sound length conversion circuit 172 formed of ROM and converted to the sound length data LEN wherein the length of the sounding period (musical length) is indicated by corresponding to the count value of the tempo-clock-signal which will be mentioned later. In this case, if the first sound length data correspond to the break note, the sound length conversion circuit 172 gives, in addition to the sound length data LEN, the break data Br indicating the length of the non-sounding period (break length) according to the count value of the tempo-clock-signal.

When the first sound length data correspond to the break note, the sound length data LEN from the sound length conversion circuit 172 are compared, in a comparator (comparing circuit) 174 with the count data of a counter 176. The counter 176 is to count the tempo-clock-signal TCL supplied from a tempo oscillator 180 through an AND gate 182 enabled by the performance-state-signal PLY, after getting reset by the start-signal ΔST supplied through the OR gate 178. When the counter 176 reaches to the count value corresponding to the note length indicated by the sound length data LEN, an equality (coincidence) signal $EQ_1$ is given from the comparison circuit 174. The equality signal $EQ_1$ causes the flip-flop 168 to be reset through an AND gate 186 enabled by the output="1" of an inverter 184. As a result, the key-on-signal KON returns from "1" to "0" and instructs the stop of the sounding of the first melody sound.

In parallel with said comparison operation in the comparison circuit 174, in a comparison circuit 188, the addition data from the adding circuit 190 adding the sound length data LEN and the break data Br are compared with the count data from the counter 176. Then, when the counter 176 reaches to the count value corresponding to the sum of the note length indicated by the sound length data LEN and the break length indicated by the break data Br, an equality-signal $EQ_2$ is given from the comparison circuit 188. The equality-signal $EQ_2$ causes the AND gate 186 to disable by means of the inverter 184, while it is supplied to the flip-flop 168 through the OR gate 170, as set input; therefore, the key-on-signal KON again becomes "1" and instructs the sounding of the second melody sound.

Also, since the equality signal $EQ_2$ causes the counter 176 to be reset through an OR gate 178, after the resetting the counter 176 again counts the tempo-clock-signal TCL to prepare for the second note length measurement.

Furthermore, since the equality-signal $EQ_2$ causes the AND gate 44 to enable by way of the AND gate 166, the OR gate 154, the AND gate 150, and the OR gate 42, the clock signal $\phi$ is supplied to the counter 40 through the AND gate 44, and the second melody sound data are read out from the pitch memory 38. Simultaneously with it, the equality-signal $EQ_2$ is supplied to the AND gate 54 from the OR gate 52 through the AND gate 192 enabled by the performance state signal PLY; therefore, the clock-signal $\phi$ is supplied to the counter 50 through the AND gate 54, and the second sound length data corresponding to the second melody sound are read out from the note length memory 48.

If the second sound length data correspond not to the break note but to the normal note, the comparison circuit 174 gives the equality-signal $EQ_1$ when the counter 176 reaches to the count value corresponding to the note length indicated by the sound length data LEN; and concurrently with it, also the comparison circuit 188 gives the equality-signal $EQ_2$, because the content of the break data Br is zero. The equality signal $EQ_2$ at this time acts on the flip-flop 168 by taking the priority to the equality-signal $EQ_1$ because of the presence of the inverter 184; consequently, the flip-flop 168 is not reset by the equality-signal $EQ_1$ but continues the set state according to the equality-signal $EQ_2$. As a result, the key-on-signal KON keeps taking the "1" level and instructs the sounding of the third melody sound. The equality signal $EQ_2$ at this time acts to let the third melody sound data be read out from the pitch memory 38, and to let the third note length data corresponding to the third melody sound to be read out from the note length memory 48, respectively, in the same manner as that in the previous time.

Figure 11:
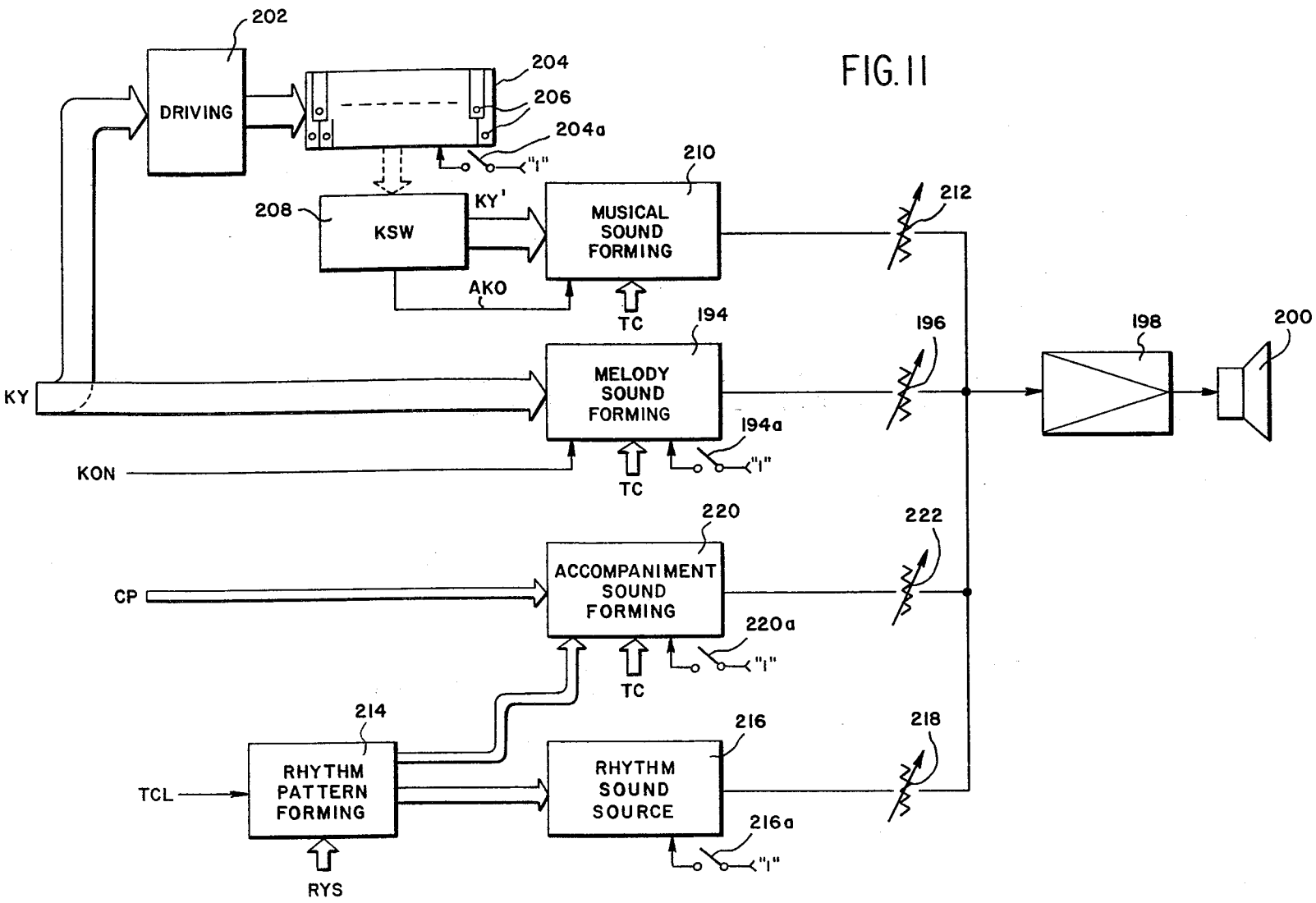
FIG. 11 is a circuit diagram showing a musical sound producing unit in the automatic performance device.

The second and third melody sound data are latched by the latch circuit 160 through the transposition circuit 158, same as in the case of the first melody sound data, and supplied to the musical sound producing unit in FIG. 11, after further converted to the keying-signal KY in the decoder 162. The key-on-signal for producing the second and third melody sounds is also supplied to the musical sound producing unit in FIG. 11.

Hereunder, the description on the musical sound producing unit in FIG. 11 will be given. A keying-signal KY corresponding to the first melody sound is supplied to a melody sound forming circuit 194. The melody sound forming circuit 194 is to electronically compose and feed the musical-sound-signal according to the keying-signal KY, the key on signal KON, and the tone command data TC, when a sounding selector switch **194*a* is ON; and the musical-sound-signal from the circuit 194 is amplified by an output amplifier 198 through a volume 196, then converted to the sound by a speaker 200. Consequently, when the sounding selector switch 194*a* is set to be ON, if the keying-signal KY instructs the key or the pitch corresponding to the first melody sound, the circuit 194 forms the first melody-sound-signal, and the first melody sound is performed through the speaker 200**.

The keying-signal KY is also supplied to a key press position indicator 204 through a drive circuit 202. The key press position indicator 204 is designed so that it indicates when the display selector switch **204*a* is being turned on, the key position to be pressed by selectively lighting the display element 206, that is like light-emitting diode and is provided in large number on for each key of the keyboard, according to the output of the drive circuit 202. Accordingly, when the display selector switch 204*a* is set to be ON, if the keying-signal KY designated the key corresponding to the first melody sound, the indicator 204** turns on the display element of the designated key in order to indicate that the key is to be depressed.

The key switch (KSW) circuit 208 includes a large number of key switches respectively interlocked with many keys of the keyboard (if the indicator 204 is made of keyboard, its keyboard) and is so designed as to supply the keying-signal KY′ for indicating which key has been depressed as well as the any-key-on-signal AKO for indicating a certain key which has been depressed to the musical sound forming circuit 210. The musical sound forming circuit 210 has the structure similar to that of the previously mentioned melody sound forming circuit 194, and it electronically composes the musical-sound-signal according to the keying signal KY′, the any-key-on-signal AKO, and the tone command data TC, then, supplies said musical sound signal to the output amplifier 198 through the volume 212. Hence, a player can easily perform the key depressing operation by referring to the key depress position display in the indicator 204 and/or to the melody sound given by the melody sound forming circuit 194, thereby benefited greatly in effective key depressing practice.

The above-mentioned musical sound producing operation is based on the assumption that the first melody sound data correspond to the normal musical notes. When the first melody sound data correspond to the break notes, the key-on-signal KON commands the minute non-sounding period between the first melody sound and the next melody sound; accordingly, during said non-sounding period, the musical sound production by the melody sound forming circuit 194 is stopped. Then, after the stop of sounding mentioned above, in the same manner as the above, the second melody sound is produced; then, the third melody sound is further produced.

When the first melody sound by the melody sound forming circuit 194 is produced, synchronously with it, the autorhythm sound also starts to be produced. In other words, when an AND gate 182 in FIG. 1 gives the tempo-clock-signal TCL in accordance with the performance-state-signal PLY, a rhythm pattern producing circuit 214 including the memory, etc. supplies the rhythm-pattern-signal corresponding to the specific rhythm pattern to the rhythm sound source circuit 216 is designed to give the rhythm-sound-signal by driving the appropriate rhythm sound source in response to the rhythm pattern signal from the rhythm pattern forming circuit 214, when a sounding selector switch **216*a* is turned on. Consequently, when the sounding selector switch 216*a* is set to be ON, upon supply of the rhythm-pattern-signal by the rhythm pattern forming circuit 214, the rhythm-sound-signal is given from a rhythm sound source circuit 216; and it is supplied to the output amplifier 198 through a volume 218, then, through the speaker 200**, the autorhythm sound is performed.

The rhythm pattern forming circuit 214 also supplies the chord-sounding-timing-signal, the base-pitch-signal, and the base-sound-producing-timing-signal, to an accompaniment sound forming circuit 220. The accompaniment sound forming circuit 220 is to electronically compose the chord-signal, according to the chord data CP, the tone command data TC, and the chord-sounding-timing-signal from the rhythm pattern forming circuit 214, and also to electronically compose the base sound signal, according to the base-sound-producing-timing-signal as well as the base pitch signal from the rhythm pattern forming circuit 214, when a sounding selector switch 220*a* is turned on. It is designed that the chord-signal or the base-sound-signal from the circuit 220 is supplied to the output amplifier 198 through a volume 222. Hence, as mentioned previously, when the chord data are read out immediately before the first melody sound data, if the sounding selector switch 220*a* is set to be ON, the circuit 220 forms the chord-signal in response to the chord data CP; therefore, the chord is performed through the speaker 220, and almost concurrently with it the first melody sound is performed.

After the production up to the third melody sound in the manner as mentioned above, by the same manner, the new melody sound data (sometimes also the chord data) and sound length data are read out from the pitch memory 38 and the note length memory 48, respectively, every time the counter 176 in FIG. 1 reaches to the count value corresponding to the note length or the note-length-plus-break-length; and the musical sound producing operation corresponding to the said read-out data is performed in the same manner as mentioned above. Then, finally, the end data are read out from the pitch memory 38.

When the end data are read out, a data discrimination circuit 156 gives an end-identification-signal FNS; and the signal FNS causes the flip-flop 144 to get reset through the OR gate 146. As a result, the performance-state-signal PLY becomes "0"; and at the same time, the performance display lamp 148 is turned off, thereby bringing a series of automatic performance mode operation to an end.

In the foregoing embodiments, as a coding method, the methods using the Huffman's code and the 01 code are described; but the other methods, such as the Shonnon-Phano's coding method, can be used. Also, in the foregoing description, the detailed description of the subroutine is omitted. The subroutine is designed to standardize the data process for the portions in a music, where the note progress patterns are identical, and to use the standardized data process whenever appropriate. By the use of such subroutine, the data quantity can be further cut down.

From the foregoing description, it should be apparent that the present invention is advantageous in that, as it is designed to store the musical note information by representing it with the codes of various lengths, the quantity of the data to be stored can be reduced radically, and also the memory and recording media with small storage capacity can be used. Furthermore, as it is designed to give the instruction on the key and musical type with regard to the data stored, music of various keys and types can be performed automatically by the use of only one automatic musical performance device.

We claim:

1. An automatic musical performance device comprising:

storing means for storing first musical note data represented by digital words whose word lengths are different in accordance with frequency in use of each note in a music to be performed;

read out means for reading out said first musical note data from said storing means;

conversion means for converting said first musical note data to second musical note data, said second musical note data being represented by digital words whose word lengths are independent of said frequency in use of each note; and producing means for producing at least one of a musical tone signal and a key designating signal in accordance with said second musical note data fed from said conversion means, said key designating signal being a signal which designates a key to be depressed in a keyboard.

2. Automatic musical performance device according to claim 1, wherein said word lengths of said first musical note data are determined in such a manner that a word length for a note of high frequency in use is shorter than that for a note of low frequency in use.

3. An automatic musical performance device comprising:

storing means for storing first note name data represented by digital words whose word lengths are different in accordance with frequency in use of each note name in a music to be performed;

read out means for reading out said first note name data from said storing means;

conversion means for converting said first note name data from said storing means to second note name data, said second note name data being represented by digital words whose word lengths are independent of said frequency in use of each note name; and producing means for producing at least one of a musical tone signal and a key designating signal in accordance with said second note name data fed from said conversion means, said key designating signal being a signal which designates a key to be depressed in a keyboard.

4. An automatic musical performance device according to claim 3 wherein said word lengths of said first note name data are determined in such a manner that a word length for a note of high frequency in use is shorter than that of for a note of low frequency in use.

5. An automatic musical performance device according to claim 3, wherein:

said storing means further stores key designating data, said first note name data having been transposed from an inherrent key to a predetermined key other than said inherrent key and said key designating data designating said inherrent key of said music;

said read out means further reads out said key designating data from said storing means; and said conversion means comprises transforming means for transforming said first note name data to third note name data, said third note name data being represented by digital words whose word lengths are independent of said frequency in use of each note name, and transposing means for transposing said third note name data to said second note name data which conform to said inherrent key of said music in accordance with said key designating data read out from said storing means.

6. An automatic musical performance device comprising:

storing means for storing note name data corresponding to notes in a music to be performed and first note length data corresponding to said notes and represented by digital words whose word lengths are different in accordance with frequency in use of each note length in said music;

read out means for reading out said note name data and said first note length data;

conversion means for converting said first note length data read out from said storing means to second note length data, said second note length data being represented by digital words whose word lengths are independent of said frequency in use of each note length; and producing means for producing at least one of a musical tone signal and a key designating signal in accordance with said note name data read out from said storing means and said second note length data fed from said conversion means, said key designating signal being a signal which designates a key to be depressed in a keyboard.

7. An automatic musical performance device according to claim 6, wherein said word lengths of said first note length data are determined in such a manner that a word length for a note of high frequency in use is shorter than that for a note of low frequency in use.

8. An automatic musical performance device according to claim 6, wherein:

said storing means further stores music group designating data which designates a music group to which said music belongs;

said read out means further reads out said music group designating data from said storing means; and said conversion means converts said first note length data to said second note length data in accordance with said music group designating data read out from said storing means.

* * * * *